US006009594A

United States Patent [19]

Grey

[11] Patent Number: 6,009,594

[45] Date of Patent: Jan. 4, 2000

[54] CLEANING HEAD

[75] Inventor: Nicholas Grey, Worcester, United Kingdom

[73] Assignee: Vax Limited, Worcester, United Kingdom

[21] Appl. No.: 08/894,331

[22] PCT Filed: Feb. 14, 1996

[86] PCT No.: PCT/GB96/00316

§ 371 Date: Sep. 10, 1997

§ 102(e) Date: Sep. 10, 1997

[87] PCT Pub. No.: WO96/25872

PCT Pub. Date: Aug. 29, 1996

[30] Foreign Application Priority Data

Feb. 18, 1995 [GB] United Kingdom ..... 9503185

[51] Int. Cl.[7] ..... A47L 11/30

[52] U.S. Cl. ..... 15/322; 15/320; 15/373; 15/393

[58] Field of Search ..... 15/320, 321, 322, 15/373

[56] References Cited

U.S. PATENT DOCUMENTS

| | | | |
|---|---|---|---|
| 3,064,300 | 11/1962 | Smith | 15/322 |
| 3,101,505 | 8/1963 | Belicka et al. . | |
| 3,460,184 | 1/1969 | Dyer . | |
| 3,654,662 | 4/1972 | Bates | 15/322 X |
| 5,212,848 | 5/1993 | Geyer | 15/401 |
| 5,301,387 | 4/1994 | Thomas et al. | 15/322 |
| 5,555,599 | 9/1996 | Markley | 15/322 |
| 5,819,366 | 10/1998 | Edin | 15/322 |

FOREIGN PATENT DOCUMENTS

| | | |
|---|---|---|
| 0542193 | 5/1993 | European Pat. Off. . |
| 2543425 | 10/1984 | France . |
| 2547191 | 12/1984 | France . |
| 2414826 | 10/1974 | Germany . |
| 3017485 | 11/1981 | Germany . |
| 94/06342 | 3/1994 | WIPO . |
| 94/06343 | 3/1994 | WIPO . |

*Primary Examiner*—Chris K. Moore
*Attorney, Agent, or Firm*—Venable; George H. Spencer; Catherine M. Voorhees

[57] ABSTRACT

In a cleaning head (10) of the kind having agitating means (26) engageable with a surface to be cleaned for agitating cleaning liquid thereon, and collecting means (25) for collection of liquid from the surface by suction, the agitating means (26) and collection means (25) are relatively movable such that one or the other is selectively prominently engaged with the surface being cleaned. In a preferred arrangement the agitating means (26) is movable relative to a housing (11) of the cleaning head while the collecting means (25) is fixed in position relative to the housing (11). Cleaning liquid is delivered to the agitating means through a passage (45) which is closed by a pad (70) at the upper side of the agitating means (26) when the latter is in its raised position. Movement of the agitating means (26) between its raised and lowered positions is controlled by means of a foot pedal (65).

21 Claims, 4 Drawing Sheets

CLEANING HEAD

BACKGROUND OF THE INVENTION

This invention relates to a cleaning head, for an apparatus for cleaning a surface by application of a cleaning liquid to the surface and removal of the cleaning liquid from the surface by suction.

More particularly, the invention relates to a cleaning head suitable for use in such cleaning of floor surfaces which are of a relatively unyielding and non-absorbent nature. Examples of materials commonly used for floors or floor coverings, and affording surfaces of the type with which the invention is intended to be used, comprise plastics materials, e.g. vinyl, in the form of a large sheet or small portions constituting "tiles" laid on an underlying supporting surface; ceramic materials, e.g. glazed or unglazed tiles; rubber based materials; or wood, cork or concrete if the surface is sealed with a suitable coating to prevent or reduce absorption of liquid.

There have been many proposals for apparatus for cleaning such surfaces by the application of a cleaning liquid thereto and removal of such liquid, together with dirt removed thereby from the surface, by suction. The cleaning liquid may be water containing a suitable detergent. Cleaning heads for such apparatus, which may be provided as part of single-purpose cleaning appliances or as accessories for multi-purpose cleaning appliances of the suction cleaner ("vacuum cleaner") type, usually include means for distributing the cleaning liquid on to the surface to the cleaned, at least one passage arranged to be connected to a source of suction and having at least one opening arranged to collect liquid from the surface being cleaned, and means for agitating the cleaning liquid whilst in contact with the surface to assist the action thereof in removing dirt from the surface. The agitating means typically comprises a brush or brushes which may be static or which may be arranged to be driven, e.g. rotated, by means such as an electric motor provided in or in association with the cleaning head. Alternatively a sponge or mop element may be provided, e.g. of suitable plastics or rubber foam or cellular material.

A cleaning head for such cleaning, and an appliance having the head, are disclosed in our International patent application, Publication No. W094/06342.

The effectiveness of a cleaning head of the general kind with which the present invention is concerned is judged by a user in terms of the quality of its cleaning action and of its ability to remove liquid together with loosened dirt from the surface being cleaned. Desirably, the surface should be left dry or almost dry so that any liquid remaining on the surface evaporates quickly.

SUMMARY OF THE INVENTION

It is broadly the object of the present invention to provide a cleaning head whose performance is improved in one or more of the above respects, and the features of the cleaning head whereby such improvement is obtained will be particularly pointed out hereafter.

It will be appreciated that a cleaning head in accordance with the invention normally is used in a predominantly reciprocating motion over the surface being cleaned. Accordingly references herein to the front and rear of the cleaning head, to the length thereof, and analogous expressions, refer to parts of the cleaning head spaced thereon in the intended direction of reciprocation thereof in use, and to dimensions in such direction. Similarly references to the sides of the cleaning head and to the width thereof, and analogous expressions, refer to the direction transverse to the direction of reciprocation of the cleaning head in normal use.

According to one aspect of the present invention, we provide a cleaning head for surface cleaning comprising a housing; agitating means engageable with the surface for agitating cleaning liquid thereon; means for delivery of a cleaning liquid to the surface in the region of the agitating means; air passage means adapted for connection to a source of suction; collecting means, engageable with the surface and communicating with the air passage means, for collection of liquid from the surface by suction; and means for effecting relative movement between the agitating means and the collecting means in a direction which, in use, is generally perpendicular to the surface being cleaned, whereby either one or other of the agitating means and collecting means at least predominantly cooperates with the surface.

A cleaning head in accordance with this aspect of the invention has the operational advantage that by effecting the relative movement between the agitating means and collecting means so that one or other thereof predominantly cooperates with the surface, the effectiveness of either the agitating means or collecting means can be improved, for better cleaning of the surface or improved collection of liquid from the surface respectively. In the course of a typical cleaning operation on a surface, the cleaning head can be used firstly in a mode in which the agitating means predominantly cooperates with the surface, and thereafter in the mode in which the collecting means predominantly cooperates with the surface, thus leaving the surface effectively cleaned and with the maximum amount of the cleaning liquid and dirt removed therefrom.

The cleaning head may comprise support means for assisting in supporting the head, in use, on a surface being cleaned. Preferably the support means comprises rotatable elements, i.e. wheels or rollers, to facilitate reciprocation of the cleaning head in the fore and aft direction.

The provision of such support means, as well as facilitating the reciprocation of the cleaning head over the surface being cleaned, enables some of the weight of an appliance such as that disclosed in our published International Patent Application No. WO94/06342 to be borne by the support means of the cleaning head rather than by the agitating means and/or collecting means thereof.

There may be respective support means spaced lengthwise of the cleaning head.

In a preferred arrangement the support means, present in the embodiment described more particularly hereafter, comprises first support members at the rear of the cleaning head and rearwardly of the agitating means, and second support members disposed generally between the agitating means and the collecting means which is disposed forwardly of the agitating means in the direction lengthwise of the cleaning head, the support means being disposed such that, when the agitating means is in its lowermost position in the cleaning head, the head will be supported in use primarily on the first support members at the rear of the head and on the agitating means whilst, when the agitating means is in its uppermost position, the head will be supported in use primarily on the spaced first and second support members and not to any significant extent on the agitating means.

The means for effecting relative movement between the agitating means and collecting means of the head may comprise means for effecting movement of the agitating means relative to the housing in a direction which, in use, is generally perpendicular to the surface being cleaned, whilst the collecting means remains at a fixed position relative to the body of the cleaning head.

Conveniently the means for effecting such movement of the agitating means is operable by a foot of a user when the cleaning head is being used to clean a floor. There may be a foot-operable member mounted in an accessible position, e.g. an upper part of the housing and movable to effect the movement of the agitating means.

The foot-operable member may be angularly movable and have cam means associated therewith for effecting the movement of the agitating means.

The agitating means may be spring biased to an upper position relative to the body of the cleaning head and movable by the cam means to a lower position upon appropriate operation of the foot-operable member.

The agitating means preferably is mounted for generally linear movement relative to the body of the cleaning head, being guided for such movement by guide means.

The agitating means conveniently comprises an array of bristles supported to extend from a support member towards the surface to be cleaned, so as to have a scrubbing action upon the surface when the cleaning head is in use. The bristles may be disposed in a number of tufts of bristles, in a line or lines of such tufts extending across the width of the cleaning head.

The agitating means preferably further comprises an element having an operative surface of densely packed thin flexible filaments such as is afforded by a pile fabric. Such an element also acts as a means for spreading the cleaning liquid in such a way that a relatively uniform distribution thereof across the width of the cleaning head will be obtained.

Preferably the means for delivering cleaning liquid to a surface is arranged to deliver such liquid to such an element, which may be backed with an open celled rubber or plastics foam element to render it resilient and assist its spreading of the cleaning liquid.

Further aspects of the invention are concerned with the arrangement and configuration of the collecting means of a cleaning head. Preferably the collecting means includes an opening for flow of air to the air passage means of the cleaning head, which opening extends across substantially the entire width of the cleaning head but is of relatively small dimensions in the direction lengthwise of the cleaning head. Such a configuration of opening enables a high velocity of air flow to be maintained to entrain liquid from the surface being cleaned, rendering collection of liquid highly effective.

Preferably the opening of the collecting means is bounded to front and rear of the opening by flexible blade or squeegee elements engageable with the surface being cleaned. Such blade elements, e.g. of rubber or rubber-like material, render the collection of liquid from the surface by suction more efficient, since their engagement with the surface as the cleaning head is reciprocated wipes the liquid on the surface into a locally increased film thickness to be more readily entrained by the flow of air.

Preferably the opening of the collecting means includes filter means, e.g. a coarse grille or a number of barrier elements, which prevents the intake of large pieces of detritus.

The air passage means of the cleaning head preferably has a mouth portion which communicates with the opening of the collecting means and which is of relatively long and narrow cross-sectional shape to cooperate with the collecting means, and a transition portion which changes in cross-sectional shape to a circular or near-circular cross-section for connection to the source of suction. In such transition portion, preferably a substantially uniform cross-sectional area is maintained despite the change in cross-sectional shape, so that air flow at high velocity through the passage means and collecting means is maintained.

The mouth portion preferably connects to the opening of the collecting means at a position generally in the centre thereof and spaced from the sides of the head, so that air flow is established in outermost parts of the collecting means in the direction transversely of the cleaning head, i.e. parallel to the blade elements of the collecting means. This provides for improved entrainment of liquid and thus better drying of the surface being cleaned.

According to another aspect of the invention, we provide a cleaning head for surface cleaning, comprising agitating means engageable with the surface for agitating cleaning liquid thereon, means for delivery of a cleaning liquid to the surface in the region of the agitating means; air passage means adapted for connection to a source of suction and having at least one opening for collection of liquid by suction from the surface; means for effecting movement of the agitating means relative to the cleaning head between operative and inoperative positions of the agitating means, and valve means operable in accordance with the position of the agitating means for permitting delivery of the cleaning liquid when the agitating means is in its operative position and preventing delivery of the cleaning liquid when the agitating means is in its inoperative position.

The valve means may comprise means for blocking a pipe, passage or orifice for delivery of the cleaning liquid in accordance with the position of the agitating means. The agitating means itself may cause such blockage, or a part or parts of a mechanism for effecting such movement of the agitating means may cause the blockage.

According to another aspect of the invention, a cleaning head may comprise any or all of the above aspects of the invention or features thereof.

BRIEF DESCRIPTION OF THE DRAWINGS

The invention will now be described by way of example with reference to the accompanying drawings, of which.

DETAILED DESCRIPTION OF THE PREFERRED EMBODIMENT

Figure 4:
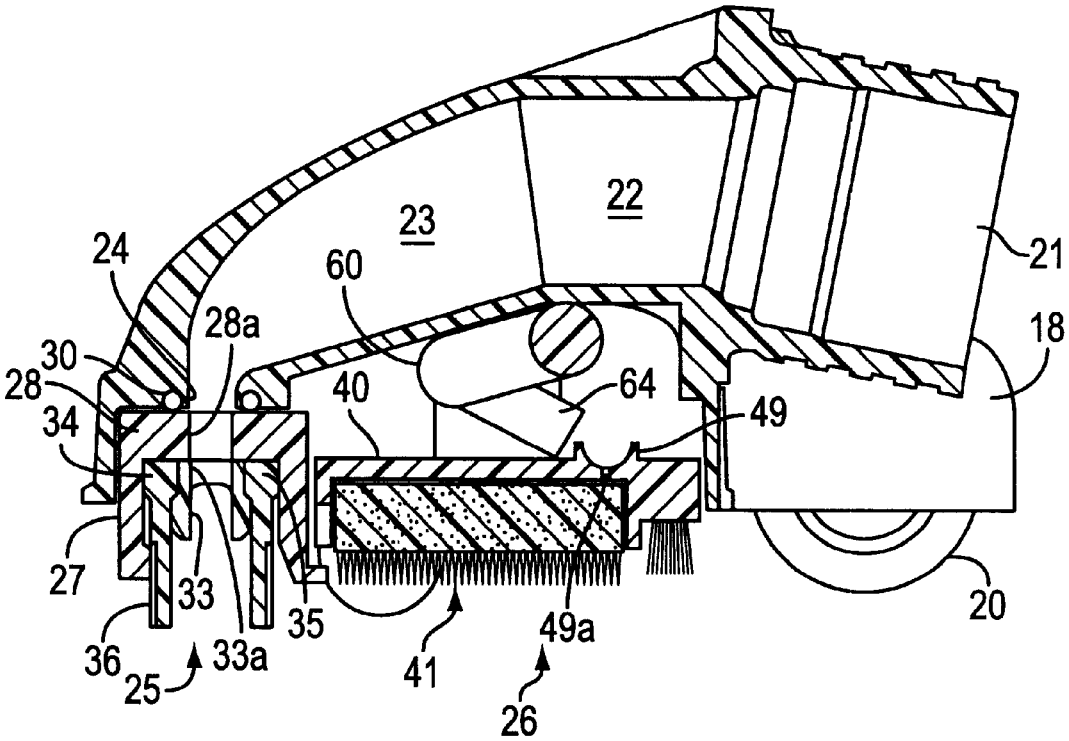
FIG. 4 is a section on the line 4—4 of FIG. 2.

Referring to the drawings, a cleaning head is indicated generally at 10. The cleaning head is intended primarily to be used as the cleaning head for an appliance such as is shown in FIG. 4 of the drawings of our International patent application Publication No. WO94/06342, but it will be appreciated that a cleaning head could alternatively be useable as part of or in association with another appliance, e.g. as a cleaning head for surface cleaning in connection with a multi-purpose cleaning appliance of the suction cleaner type, and may be either mounted directly at the lower end of an appliance which is used in a generally upright or inclined orientation, or connected at the free end of a suction hose from a free-standing appliance.

The head 10 comprises a housing 11 which conveniently is a moulding of a suitable plastics material and which is generally in the form of an inverted shallow trough with a top wall 12 and front, side, and rear walls 13, 14, 15 respectively. Above the top wall 12 and to the rear of the body there is a formation 16 terminating in a spigot 17 which is configured for attachment of the cleaning head to an appliance such as above referred to, or to, for example, the hose of a suction cleaning appliance. Behind the rear wall 15, the body has extensions 18 disposed one to either side of the spigot 17 and in which are supported, for rotation about axes 19, rollers 20 for engagement with a surface on which the cleaning head is to be used to assist in supporting the cleaning head relative to such surface.

Within the spigot 17 there is defined a passage 21 for air flow, which extends forwardly and downwardly of the cleaning head by way of a portion 22 at least partially within the formation 16 on the top of the cleaning head and a further, transition, portion 23 in which the cross-sectional shape of the passage changes from being generally circular to being narrow and elongated in the direction of the width of the cleaning head. The portion 23 of the passage terminates in a downwardly facing mouth 24 adjacent the front wall 13 of the head, and the transition passage portion 23 is configured so that throughout its change of cross-sectional shape it defines a substantially constant cross-sectional area.

The housing 11 of the cleaning head receives a collecting assembly indicated generally at 25 and described in greater detail hereafter, the collecting assembly being cooperable with a surface being cleaned and communicating with the passage means 21 by way of the passage portions 22 and 23 for collection of liquid from the surface being cleaned by suction, which liquid is entrained by air flow to the source of suction to which the cleaning head is to be connected. The housing 11 of the cleaning head further accommodates an applicator assembly indicated generally at 26 as described in greater detail hereafter, and comprising means for delivery of cleaning liquid to the surface being cleaned and agitating means adapted to agitate such liquid to assist the cleaning operation.

Figure 2:
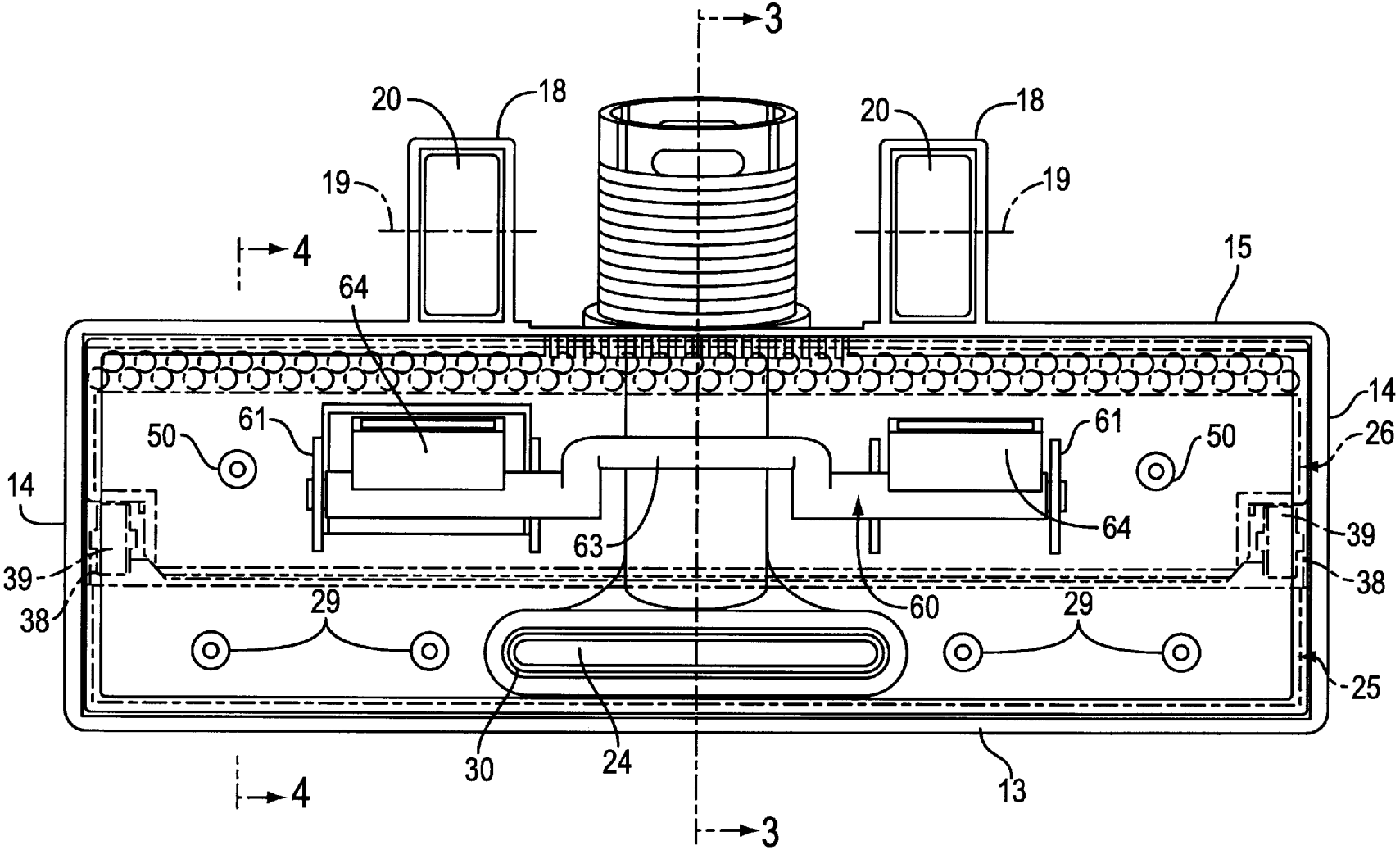
FIG. 2 is an underneath plan view of the cleaning head, with parts thereof shown in outline only.

The collecting assembly 25, which is indicated in outline by chain-dotted lines in FIG. 2, comprises a body 27 of inverted trough-like form and opening downwardly, extending substantially the whole width of the cleaning head and approximately one-third of the distance from front to rear of the cleaning head. It has a base portion 28 which abuts against suitable support formations indicated at 29 in the body of the cleaning head and is secured thereto by screws extending through the base portion 28 and engaging the formations 29. The base portion 28 has an elongate aperture 28*a* which matches the shape of the mouth 24 of the passage portion 23 and a sealing ring 30 provides for a substantially leak-free connection between the collecting means and the mouth 24. The collecting means 25 has two rearward extensions 38 in which are rotatably supported respective further support rollers 39 adjacent the side walls 14 of the cleaning head.

The body 27 of the collecting assembly accommodates two flexible wiper or squeegee blades 31, 32 spaced from one another in the direction forwardly and rearwardly of the cleaning head and held therein by an apertured retaining member 33 of inverted U-shape secured by screws (not shown) to the base portion 28 of the collecting means and cooperating with enlarged head portions 34, 35 of the blades 31, 32. The retaining member 33 has an aperture 33*a* in register with the aperture 28*a* and may incorporate a grille so as to prevent access of large pieces of detritus, e.g. cloth, from entering the air flow passage through the cleaning head, without substantially restricting such air flow.

The blades 31, 32 are of rubber or like material and are sufficiently flexible to bend forwardly or rearwardly with motion of the cleaning head over the surface. The outer, oppositely facing surfaces of the blades are corrugated as indicated at 36, in known manner. Considering the forward blade 31, when the cleaning head is being pushed forwardly and the blade is bent rearwardly over the surface being cleaned, liquid on such surface can flow through the corrugations to the space between the blades 31, 32, whilst when the head is being moved rearwardly over the surface and the blade is bent towards the front of the cleaning head it acts as a wiper or squeegee blade to retain liquid in the space between the blades. Thence the liquid is readily entrained by air flow through the collecting means to be removed from the surface. In the outermost end portions of the collecting means, such air flow is mainly in the direction parallel to the blades towards the aperture 28*a* in the base portion of the body 27, so that the liquid is drawn inwardly towards the central region of the collecting means and then upwardly from the surface.

The applicator assembly 26 comprises a body 40, including a downwardly facing trough-like portion in which is supported an agitating means comprising a pad 41 including an open celled foam plastics block with a fibre pile facing layer. The body 40 has a rearward portion 43 which supports two rows of tufts of bristles 44. Both the rows of tufts of bristles 44 and the pad 41 extend across substantially the entire width of the cleaning head. The pad 41 provides for spreading of cleaning liquid on the surface being cleaned and for a mild agitation of such liquid, whilst the bristles 44 provide for a scrubbing action on the surface to assist cleaning if the surface is very dirty or the dirt is ingrained on the surface.

For delivering cleaning liquid, which usually will be water containing a suitable detergent, to the agitating pad 41 and thus to the surface being cleaned, the housing 11 has a liquid passage 45 extending upwardly through it. At its uppermost end, the passage 45 lies within an inlet spigot 46 for connection to a flexible tube leading to a reservoir of the cleaning liquid. At its lowermost end, the liquid passage 45 terminates in an outlet spigot 47 which is arranged within a pair of generally semi-cylindrical walls 48 that form a local enlargement of a trough formation 49 at the upper side of in the body 40 of the applicator assembly 26, the trough 49 extending laterally across substantially the entire width of the applicator assembly and having a number of spaced apertures 49*a* leading through the top of the body 40 into the part thereof occupied by the pad 41. Thus the cleaning liquid is deliverable to the applicator assembly for application to the surface being cleaned through the applicator pad.

In accordance with the invention the applicator assembly 26 is mounted for upwards and downwards movement relative to the body of the cleaning head. For this purpose, the housing 11 has two laterally spaced posts 50 extending downwardly from its top wall 12, and the body 40 of the agitating means has correspondingly spaced upwardly extending tubular spigots 51 which each terminate in a radially inwardly extending flange 52 slidable up and down the external surface of the corresponding post 50. A coil compression spring 53 is disposed within each spigot 51 and abuts the flange 52, the other end of the spring abutting a washer 54 held by a screw 55 screwed into a bore extending upwardly into the post 50. Thus the applicator assembly is guided for movement in upwardly and downwardly relative to the housing 11 of the cleaning head but is spring biased upwardly relative thereto.

Figure 1:
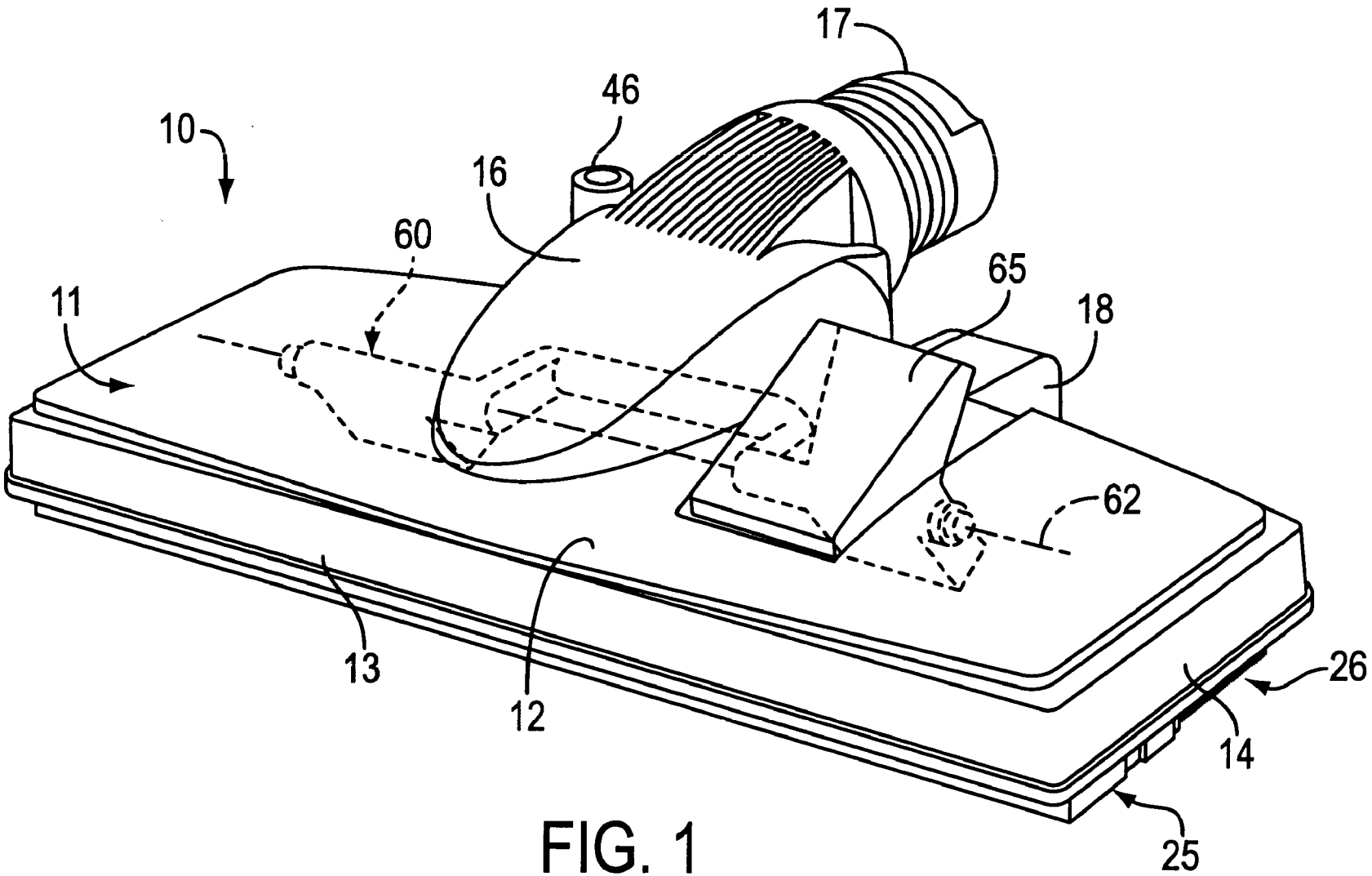
FIG. 1 is a perspective view of a cleaning head in accordance with the invention and with an applicator assembly in a raised position.
Figure 3:
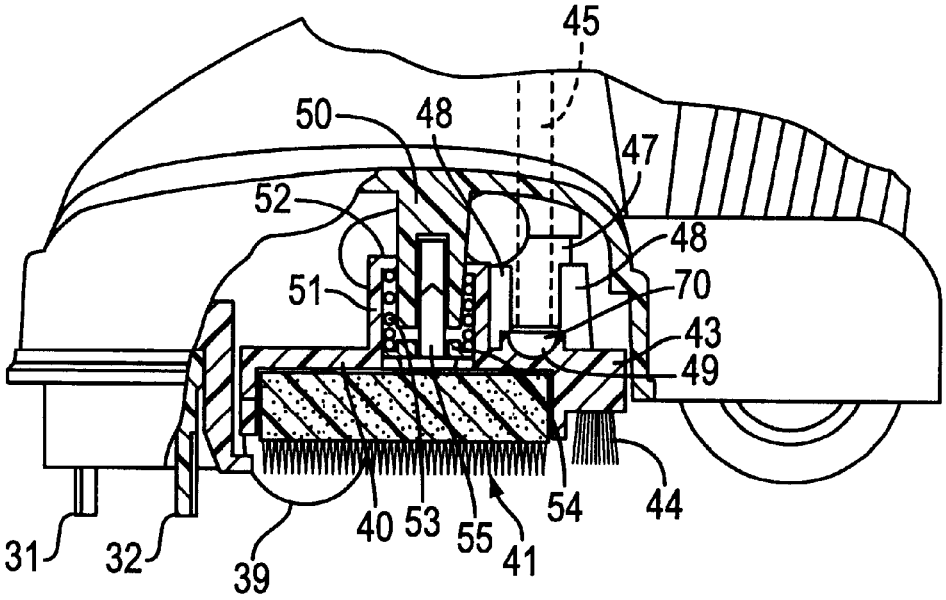
FIG. 3 is a partial section on the line 3—3 of FIG. 2.

Beneath the top wall 12 of the cleaning head housing there extends a transverse shaft 60, the shaft being supported at its opposite ends, in formations 61 extending downwardly from the top wall 12, for angular movement about an axis 62. The shaft has a cranked portion 63 in its central region to clear the passage portions 22, 23 in the top of the housing of the cleaning head. Adjacent its ends, the shaft 60 has respective cam formations 64 which are engageable with the upper surface of the body 40 of the applicator assembly 26 of the head. The shaft further has a foot engageable pedal portion 65 which extends through an aperture in the top wall 12 of the head so as to be operable in a forwards or rearwards rocking motion by a foot of a user of the head. When the pedal 65 is in its forward position as shown in FIGS. 1 to 3, the applicator assembly 26 is permitted to remain, under the bias of its springs 53, in its uppermost position relative to, and substantially within, the housing 11 of the cleaning head.

Figure 5:
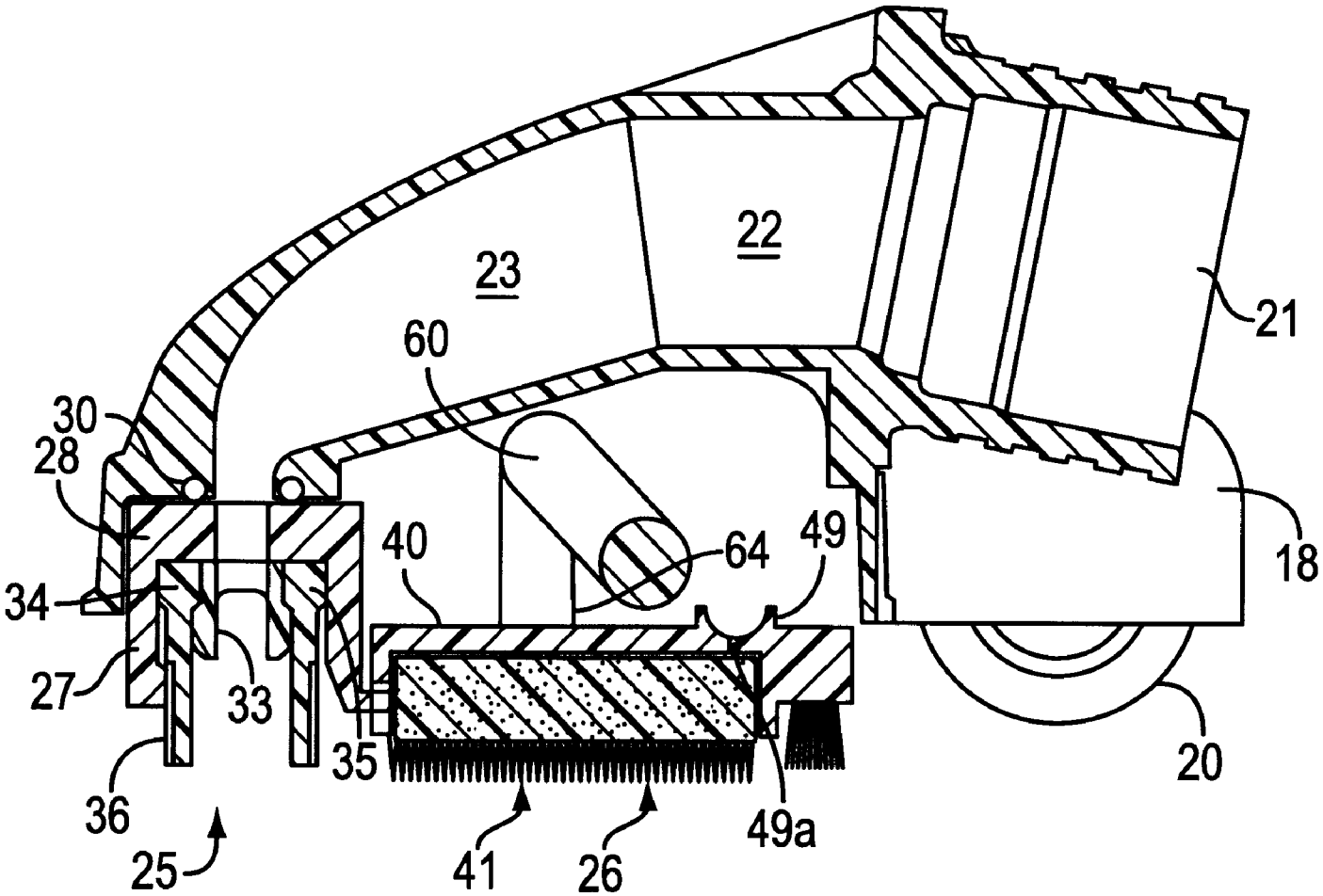
FIG. 5 is a view similar to FIG. 4 but with the applicator assembly in a lowered position.

When the pedal 65 is rocked rearwardly by a user of the cleaning head, the cam formations 64 engage the upper surface of the body 40 of the applicator assembly 26 and push the latter downwardly against the biasing of springs 53 until the position shown in FIG. 5 is reached. Substantially planar end faces of the cam formations 64 squarely abut the upper surface of the body 40 of the body 40 of the applicator assembly, so that such position is retained without the necessity for the user to maintain rearwards-rocking pressure on the pedal 65.

When the applicator assembly is in its lowermost position relative to the body of the cleaning head the pad 41 and bristles 44 project substantially below the housing 11 and engagement between the cleaning head and a surface being cleaned is primarily by way of the agitating pad 41, although it will be appreciated that if the head is tilted rearwardly the rollers 20 will engage the surface and ultimately, if rearward tilting is continued, support all the weight of the cleaning head. Conversely if the head is tilted forwardly the blades 31, 32 of the collecting assembly will engage the surface to a greater extent. In the normal attitude of the cleaning head relative to the surface, however, the predominant engagement of the agitating pad 41 with the surface provides for effective cleaning of the surface. When the applicator assembly 26 is raised relative to the cleaning head to the position in which it is shown in FIGS. 3 and 4, operative engagement of the cleaning head with the surface is predominantly by way of the blades 31, 32 of the collecting means although the weight of the cleaning head is supported relative to the surface by rollers 20, 39. In this latter condition, improved collection and removal of liquid from the surface is achieved.

Control of delivery of the cleaning liquid to the surface may be effected by way of a valve which is manually operable under the control of the user of the appliance with which the cleaning head is associated. Preferably, however, valve means is associated with the applicator assembly 26 or the mechanism for effecting the upwards and downwards movement of the applicator assembly, so that delivery of the cleaning liquid takes place when the applicator assembly is in its lowered position but is prevented when the applicator assembly is in its raised position. In the latter case, effective drying of the cleaned surface is obtained since cleaning liquid is no longer being delivered thereto. Such valve means in the embodiment illustrated comprises a rubber pad 70 arranged in the local enlargement of the trough 49 to block an orifice at the end of the outlet spigot 47 of the passage 45 when the applicator assembly is in its raised position. In an alternative arrangement a flexible tube portion of the passage 45 may be obturated by being pinched when the applicator assembly is raised.

Thus the invention provides a cleaning head having a number of features, as set forth above, which enhance its effectiveness is use.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A cleaning head for surface cleaning comprising:

a housing;

agitating means carried by said housing and engageable with a surface to be cleaned;

delivery means accommodated within said housing for delivery of a cleaning liquid to the surface to be cleaned in the region of the agitating means, said agitating means adapted for agitating the cleaning liquid thereon;

air passage means accommodated within said housing adapted for connection to a source of suction and having at least one opening for collection of liquid by suction from the surface;

operating means for effecting movement of the agitating means relative to said housing between an operative position and an inoperative position; and valve means operatively connected with said agitating means for permitting delivery of the cleaning liquid by said delivery means when the agitating means is in its operative position and preventing delivery of the cleaning liquid when the agitating means is in its inoperative position.

2. The cleaning head according to claim 1, wherein said delivery means includes a passageway and said valve means comprises means for blocking said passageway.

3. The cleaning head according to claim 2, wherein said passageway includes an outlet spigot and said valve means further comprises a blocking member, which is moveable by said operating means into and out of contact with said outlet spigot.

4. The cleaning head according to claim 3, wherein said agitating means includes an applicator pad mounted on a support member, said support member has a liquid distribution trough thereon, and is formed with a plurality of apertures leading from said trough to said applicator pad, and said blocking member is located in said trough in communication with said outlet spigot.

5. A cleaning head for surface cleaning comprising:

a housing having a front end and a rear end;

agitating means carried by said housing and engageable with a surface to be cleaned;

delivery means for delivery of a cleaning liquid to the surface to be cleaned in the region of the agitating means, said agitating means adapted for agitating the cleaning liquid thereon;

air passage means adapted for connection to a source of suction;

collecting means disposed between said agitating means and said front end of said housing, engageable with the surface and communicating with said air passage means, for collection of liquid from the surface by suction;

operating means for effecting movement of the agitating means relative to said housing between operative and inoperative positions in a direction which, in use, is generally perpendicular to the surface being cleaned, whereby said agitating means and said collecting means are selectively disposed to co-operate with the surface; and support means carried by said housing for assisting in supporting the head on said surface being cleaned, wherein said support means comprises rear support members disposed at said rear end of said housing and forward support members disposed adjacent to said agitating means, said forward and rear support members being disposed such that, when the agitating means is in its operative position, the head, when in use, is supported partly on said rear support members and partly on said agitating means, and when the agitating means is in its inoperative position, the head, when in use, is supported on said rear support members with said agitating means substantially clear of the surface.

6. The cleaning head according to claim 5, further comprising valve means for permitting delivery of the cleaning liquid when said agitating means is in its operative position.

7. The cleaning head according to claim 6, wherein said valve means is operatively connected with said agitating means so as to prevent delivery of the cleaning liquid when said agitating means is in its inoperative position.

8. The cleaning head according to claim 7, wherein said delivery means includes a passageway and said valve means comprises means for blocking said passageway.

9. The cleaning head according to claim 8, wherein said passageway includes an outlet spigot and said valve means further comprises a blocking member, which is moveable by said operating means into and out of contact with said outlet spigot.

10. The cleaning head according to claim 9, wherein said agitating means includes an applicator pad mounted on a support member, said support member has a liquid distribution trough thereon, and is formed with a plurality of apertures leading from said trough to said applicator pad, and said blocking member is located in said trough in communication with said outlet spigot.

11. The cleaning head according to claim 5, further comprising spring means for biasing said agitating means into its inoperative position relative to the housing and wherein said operating means includes a foot-operable member mounted on said housing and engaging with said agitating means to displace said agitating means from said inoperative position into said operative position.

12. The cleaning head according to claim 11, wherein said housing includes guide means for movement of said agitating means in a generally linear manner relative to said housing.

13. The cleaning head according to claim 5, wherein said agitating means includes an array of bristles carried by a support member to provide for a scrubbing action on the surface when the agitating means is in its operative position.

14. The cleaning head according to claim 13, wherein said agitating means further comprises a cleaning element formed from an open-celled foam material.

15. The cleaning head according to claim 14, wherein said cleaning element is provided with an operative surface of densely packed thin flexible filaments.

16. The cleaning head according to claim 15, wherein said delivery means is arranged to deliver cleaning liquid to said cleaning element.

17. The cleaning head according to claim 14, wherein said delivery means is arranged to deliver cleaning liquid to said cleaning element.

18. The cleaning head according to claim 5, wherein said collecting means includes an opening for flow of air to said air passage means, the opening extending substantially across the entire width of the cleaning head and is of relatively small dimensions in the direction lengthwise of the cleaning head.

19. The cleaning head according to claim 18, wherein squeegee elements are provided adjacent to said opening.

20. The cleaning head according to claim 19, wherein said air passage means has a mouth portion which communicates with said opening of the collecting means and which is of relatively long and narrow cross-sectional shape to cooperate with said collecting means, and a transition portion which changes in cross-sectional shape to a circular or near-circular cross-section for connection to the source of suction.

21. The cleaning head according to claim 20, wherein said mouth portion connects to said opening at a position in the center thereof so that air flow is established in laterally outermost parts of said collecting means.

* * * * *